United States Patent [19]

Goubert

[11] Patent Number: 4,813,901

[45] Date of Patent: Mar. 21, 1989

[54] DEVICE FOR THE AUTOMATIC CENTERING OF CATHODES IN EYELETS FOR CATHODE TUBE ELECTRON GUN

[75] Inventor: Jean C. Goubert, Lyon Bron, France

[73] Assignee: Videocolor, Montrouge, France

[21] Appl. No.: 139,026

[22] Filed: Dec. 29, 1987

[30] Foreign Application Priority Data

Dec. 29, 1986 [FR] France ..... 86 18298

[51] Int. Cl.[4] ..... H01J 9/06

[52] U.S. Cl. ..... 445/67; 445/36

[58] Field of Search ..... 445/2, 3, 34, 36, 67

[56] References Cited

U.S. PATENT DOCUMENTS

| | | | |
|---|---|---|---|
| 3,156,030 | 11/1964 | Natalis | 445/67 |
| 3,533,147 | 10/1970 | Baur et al. | 445/34 |
| 3,584,182 | 6/1971 | Volk et al. | 219/87 |
| 4,176,432 | 12/1979 | McCandless | 445/36 |
| 4,449,951 | 5/1984 | Nill | 445/36 |

*Primary Examiner*—Kenneth J. Ramsey

*Attorney, Agent, or Firm*—Oblon, Fisher, Spivak, McClelland & Maier

[57] ABSTRACT

To center a cathode tube gun cathode in its eyelet, the rear end of the central electrode is fixed in a flexible bearing and this end is connected by a flexible joint to a pusher forcing the electrode into a rotational movement so that it becomes aligned with the axis of the eyelet.

3 Claims, 1 Drawing Sheet

DEVICE FOR THE AUTOMATIC CENTERING OF CATHODES IN EYELETS FOR CATHODE TUBE ELECTRON GUN

BACKGROUND OF THE INVENTION

1. Field of the Invention

The present invention pertains to a device for the automatic centering of cathodes in eyelets for cathode tube electron guns.

2. Description of the Prior Art

One technology for fixing the electron gun cathodes of cathode tubes uses "eyelets" which are substantially shaped like sleeves flared on one side, the flared part ending in a collar. This collar is fixed to a supporting electrode set just behind the first grid of the gun. The cathode is inserted into this eyelet and can move freely inside it. The said cathode is held at the end of a hollow rod connected to a vacuum tap. This rod is generally called a "central electrode". When the distance between the active side of the cathode and the first or second grid is set at the desired value, the cathode is welded to the eyelet, generally by spot welding, at three or four spots.

However, despite all the care that might be taken in fixing the eyelets, they often have positioning errors such as displacements in translation or inclination with respect to the theoretical axis. Faults of this type adversely affect the correct positioning and setting of the cathodes, and could damage the cathodes when they are inserted in the eyelets or when the instruments used to place them are withdrawn.

3. Summary of the Invention

An object of the present invention is a device which can be used, when the cathodes are being automatically positioned in the eyelets, to compensate for errors in the positioning and alignment of the three cathode eyelets of an electron gun. This device also enables the forward and backward movement of the cathode in the eyelet to adjust the distance between the cathode and the first grid of the gun, practically without any gap between the cathode and its eyelet.

The device according to the invention has a "central electrode" fixed to a support, which is movable in the direction in which the cathode is set, by means of a flexible or floating bearing, the rear part of this said central electrode being connected by a joint to a pusher which is movable in the same direction as the support but is capable of being actuated independently of the said support. Should the central electrode be hollow, it is advantageously connected to a vacuum tap.

BRIEF DESCRIPTION OF THE DRAWINGS

The present invention will be better understood from the following detailed description of an embodiment taken as a non-exhaustive example and illustrated by the appended drawing, of which.

DESCRIPTION OF A PREFERRED EMBODIMENT

Figure 1:
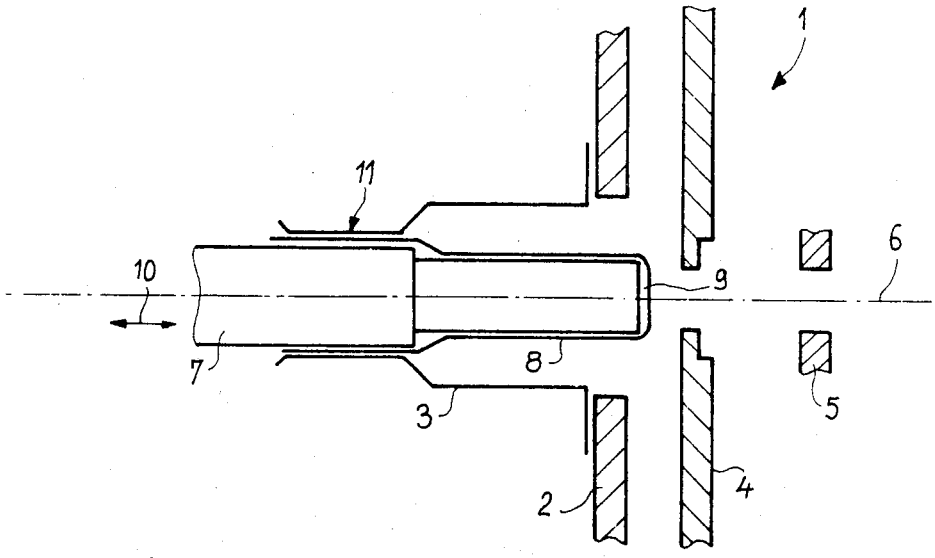
FIG. 1 is a simplified and partial cross-section view showing the end of a central electrode during the positioning of a cathode in a cathode eyelet.

FIG. 1 gives a partial view of the gun 1 of a cathode tube, namely: the electrode 2 supporting the eyelets of the cathodes with an eyelet 3, the first grid (G1) 4 and the second grid (G2) 5. The figure also shows the axis 6 of the alignment of the elements 4 and 5 which should also be the axis of the eyelet 3 and the central electrode 7, at the end of which is held the cathode 8 if the eyelet 3 is fixed very precisely on its support 2 (and if this support 2 is truly perpendicular to the axis 6).

The cathode 8 is kept fixed on the end of the electrode 7 in an appropriate manner. For example, if this electrode is hollow, it is connected to a vacuum tap. The position of the cathode 8 is fixed in the eyelet 3 so that the distance between the active side 9 of this cathode and the facing side of G1 will have a determined value by shifting the electrode 7 in the direction of the axis 6 (double-headed arrow 10). A setting operation of this type is known per se and shall therefore not be described in greater detail herein. When the cathode is in the desired position, it is welded to the eyelet 3, for example, by spot welding, generally with 3 or 4 spots. One of these welding spots is indicated by an arrow 11.

FIG. 1 refers to an ideal case where the axis of the eyelet 3 coincides exactly with the axis 6. In practice this is rarely the case: either the axis of the eyelet 3 is parallel to the axis 6 but offset from it or the axis of the eyelet makes a non-zero angle with the axis 6. The insertion of the cathode in the eyelet and/or the withdrawal of the central electrode after the cathode is welded in the eyelet (after removing the vacuum applied to the electrode 7 if need be) might damage the cathode. Furthermore, since the cathode is not quite centered with respect to its eyelet, the spot welding may be defective at the spots or the distance between them may be too great.

To avoid all these major disadvantages, the present invention provides for the relatively flexible actuation of the central electrode 7. The front end of the electrode 7 is presented at the outlet of the cathode 8 along the axis 6, but if the axis of the cathode 8 does not coincide with the axis 6, the electrode 7 which is not fixed rigidly to its supporting frame may, within fairly wide limits, be tilted slightly to become aligned with the axis of the cathode These limits are sufficiently wide to compensate for possible misalignments of the cathodes within tolerances.

Figure 2:
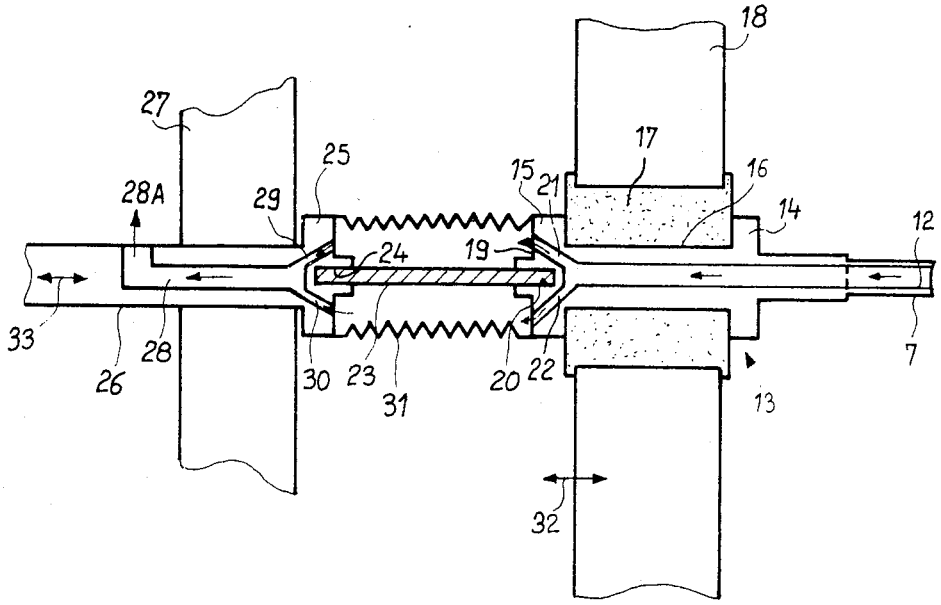
FIG. 2 is a cross-section view of a device according to the invention set at the other end of the central electrode.

FIG. 2 shows an embodiment of this device for actuating the central electrode 7. Only the rear end (the one opposite the end inserted into the cathode) of the electrode 7 has been shown. According to this embodiment, the electrode 7 is hollow and has an axial bore 12.

The flexible fixing 13 of the rear end of the electrode 7 is made as follows. This end, which has a diameter slightly greater than that of the body of the electrode, has two collars 14, 15. The collar marked 15 is almost at the tip of the end. That portion of the end of the electrode between the two collars 14, 15 is marked 16, and it is supported by a cylindrical flexible bearing 17, made of thermoplastic foam for example. It :s also possible to use floating bearings such as pneumatic or spring bearings. The thickness of the bearing 17 is substantially equal to the distance between the facing sides of the collars 14, 15, and its internal diameter is substantially equal to the external diameter of the part 16. Of course, the diameter of the collars 14, 15, and especially the diameter of the collar 15, is small enough to enable their insertion in the hole of the bearing 17 without damaging this bearing, but this diameter is large enough for the electrode to be held in the bearing, given the flexibility of the material of which the bearing is made. The bearing 17 is fixed in a hole of a movable support 18. This fixing can be done by any appropriate known method: either, as shown in the drawing, by forming collars near the front sides of the bearing or by bonding this bearing into the hole of the support or, again, by using ring-shaped flanges screwed into the support, etc.

In the front side 19 of the end of the electrode 7, an axial blind hole 20 is made. So that the axial bore 12 can open out on this side 19 without meeting the blind hole 20, this bore 12 is ended by two holes 21, 22 that form a "Y" with it. These two holes 21, 22 opening out on the side 19 near its edge.

A flexible actuating pin 23 is fixed into the blind hole 20. This pin 23 should be flexible and should, at the same time, withstand buckling strains. For example, steel wire of the "piano string" type may be used. The other end of the pin 23 is fixed into a blind hole 24 made in the front side of the end 25 of an actuating element 26 fixed to a movable support 27. The supports 18 and 27 are both movable in the direction of the axis 6 but are not joined to each other.

The actuating element 26 which is, for example, shaped like a rod with a circular section, is drilled along a part of its length with an axial bore 28 that opens out, for example radially, beyond the support 27 and is connected to a vacuum tap 28A. At its other end, the axial bore 28 opens out on the side 25 by two branches 29, 30 which form a "Y" with it. The junction of the holes 29, 30 with the bore 28 is at a sufficient distance from the bottom of the blind hole 24 to prevent any perforation of this bottom.

The front facing sides of the ends 15 and 25 are circular and have the same diameter. They are connected in a hermetically sealed way by an axially flexible cylindrical tube 31, for example, a tombac. Thus, the bore 12 of the electrode 7 communicates with the vacuum tap 28 through the holes 21, 22, 29, 30, 28 and the internal volume of the tube 31. The maximum distance between the supports 18, 27, which is at the same time the nominal distance between them, is determined by the length of the cylinder 31 when it is idle, and the minimum distance is determined by the maximum possible deflection of the pin 23, it being understood that this pin should not then deform or, in any case, damage the cylinder 31.

The device described above is used as follows. With the supports 18 and 27 at their nominal distance from each other, a cathode is passed through the free end of the central electrode, and the vacuum source 28A is connected to the bore 28, with no gun facing the device. Then a gun is placed facing this device so that its axis coincides with the axis of the end of the electrode 7. Then the supports 18 and 27 are brought closer to the gun, together and at the same speed, until the side 9 of the cathode is lightly engaged in the entrance of the eyelet 3. Since the diameter of the front part of the cathode 9 is smaller than the diameter of the entrance of the eyelet, it is always possible, even for maximum misalignments (within manufacturing tolerance limits) of the eyelets, to insert this end of the cathode into the eyelet.

To determine whether the axis of the eyelet coincides with the axis 6, it suffices to place the cathode along this axis 6 and, with a strain gauge (not shown), to gauge any resistance to the insertion of the cathode 8 in the eyelet 3. If the eyelet 3 is properly centered on the axis 6, there is no resistance to insertion and the supports 18 and 27 are shifted in one and the same movement. If this is not so, the cathode encounters resistance from the very beginning of its insertion if there is a major misalignment, or later if there is a smaller misalignment (the diameter of the front part of the cathode is smaller than that of its rear part). As soon as a resistance is gauged, the motor that actuates the support 27 brings it gently towards the support 18 which becomes immobilised, the result of this being to deflect the pin 23. This deflection causes the electrode 7 to rotate around a point which is substantially at the level of the point where the cathode meets the eyelet, until the axis of the electrode 7 is aligned with the axis of the eyelet 3, this being possible because of the flexible bearing 17. At this moment, the resistance to insertion disappears or decreases sharply, the movement in which the support 27 comes closer to the support 18 is stopped and the two supports are shifted simultaneously at the same speed. The cathode 8 is then shifted parallel to the axis of the eyelet 3 which, therefore, does not coincide with the axis 6. The distance between the side 9 of the cathode and the grid G1 (or G2) is adjusted in the usual way (double-headed arrows 32, 33 for the supports 18, 27 respectively). As soon as the right distance is obtained, the eyelet and the cathode are welded (at spots such as the spot 11), the vacuum is eliminated and the two supports 18 and 17 are retracted simultneously at the same speed, thus making it possible to withdraw the electrode 7 along the axis of the cathode 8, hence, without any risk of damaging the cathode.

Of course, instead of the pin 23, it is possible to use any joint that has the same effect of shifting the alignment of the electrode 7, for example a joint with pivots.

By using three devices such as the one described above, all three cathodes of a trichromatic cathode tube can be inserted at the same time since their reduced bulk makes it possible to place them side by side while keeping to the center distances of axes of a trichromatic gun. On the contrary, in the prior art, the three cathodes had to be inserted one after the other.

What is claimed is:

1. A device for the automatic centering of cathodes in eyelets, for cathode tube electron guns, comprising a "central electrode" fixed to a support which can move in the direction in which the cathode is set, wherein the rear part of this said central electrode being fixed to its support by a flexible or floating bearing and connected by a joint to a pusher which is movable in the same direction as the support but is capable of being actuated independently of the said support.

2. A device according to the claim 1 wherein the joint has a flexible and elastic rod that withstands buckling strains, fixed by one end to the rear end of the central electrode and by the other end to the pusher.

3. A device according to the claim 1 using a hollow central electrode, wherein the rear part of the said electrode is connected to a vacuum tap by hermetically-sealed connecting means comprising a flexible part at the junction with the electrode.

* * * * *